US006647599B2

(12) United States Patent
Lin

(10) Patent No.: US 6,647,599 B2
(45) Date of Patent: Nov. 18, 2003

(54) POSITIONING MECHANISM OF A ZIPPER SLIDE

(76) Inventor: Yu-Pau Lin, No. 151, Kung Erh Rd., Wu Lin Tsuen, Lung Tan Hsiang, Tao Yuan Hsien (TW)

( * ) Notice: Subject to any disclaimer, the term of this patent is extended or adjusted under 35 U.S.C. 154(b) by 0 days.

(21) Appl. No.: 10/113,669

(22) Filed: Apr. 2, 2002

(65) Prior Publication Data

US 2003/0182775 A1 Oct. 2, 2003

(51) Int. Cl.[7] ..... A44B 19/30

(52) U.S. Cl. ..... 24/421; 24/420; 24/425; 24/419

(58) Field of Search ..... 24/419, 421, 429, 24/431, 430, 432, 436, 415, 424

(56) References Cited

U.S. PATENT DOCUMENTS 3,813,736 A * 6/1974 Fukuroi ..... 24/424
4,667,376 A * 5/1987 Ishii et al. ..... 24/421
5,195,221 A * 3/1993 Kanamaru et al. ..... 24/429
5,528,802 A * 6/1996 Akashi ..... 24/420
5,664,300 A * 9/1997 Mizuno ..... 24/424
5,729,874 A * 3/1998 Mizuno ..... 24/429
5,806,151 A * 9/1998 Uchiyama ..... 24/418
5,848,455 A * 12/1998 Ikehara et al. ..... 24/422
5,924,174 A * 7/1999 Mizuno ..... 24/421
6,237,199 B1 * 5/2001 Chou Wang ..... 24/429

* cited by examiner

*Primary Examiner*—Anthony Knight
*Assistant Examiner*—André L. Jackson
(74) *Attorney, Agent, or Firm*—Rosenberg, Klein & Lee

(57) ABSTRACT

A positioning mechanism of a zipper slide for engaging or disengaging two lengths of teeth on two opposite teeth tapes is disclosed. The positioning mechanism includes: a main body having a buckling portion, a plane surface, a recess, and a support portion formed thereon, wherein a positioning member positioned on the buckling portion of the main body, wherein the positioning member has a locking part, which can insert into the recess of the main body, formed in one end of the positioning member; a pull tab unit for facilitating the manipulation of pulling the zipper slide, wherein the pull tab unit has a beam that is placed on the plane surface; and a lid connected with a top surface of the main body and covering the buckling portion, the plane surface, the recess, the support portion, the positioning portion, and the front of the pull tab unit.

7 Claims, 5 Drawing Sheets

POSITIONING MECHANISM OF A ZIPPER SLIDE

BACKGROUND OF THE INVENTION

1. Field of the Invention

The present invention relates to the field of zipper slides, and more particularly to a zipper slide provided with positioning means for restraining interlocking teeth thereof from disengaging when the slide has been moved with a coupled pull tab to a desired position on a zipper.

2. Description of the Prior Art

FIG. 1 to FIG. 3 illustrate a typical positioning mechanism for a zipper slide. As shown in FIG. 1, the positioning mechanism generally includes a slide body 10 that is integrally made by metal or the like, a positioning member 11, a lid 12 and a pull tab unit 13. On a top surface of the slide body 10 there are provided a buckling portion 101 and an upwardly extending support portion 102. The buckling portion 101 and the support portion 102 are used to buckle the positioning member 11 and the lid 12, respectively. Between the buckling portion 101 and the support portion 102 there are provided a plane surface 105 and a recess 103. When assembled, a beam 131 of the pull tab unit 13 is placed on the plane surface 105 (as indicated in FIG. 3). The lid 12 covers the buckling portion 101, the plane surface 105, the recess 103, the support portion 102, the positioning member 11, and the front of the pull tab unit 13.

Engagement channel 104 is provided in a front end of the slide body 10. As shown in FIG. 2, the engagement channel 104 slides along the lengths of interlocking teeth 141 of the teeth tapes 14 to facilitate the engagement and disengagement thereof.

The positioning member 11 is monolithically made by using punching technique known in the art. On top of the positioning member 11 there is a pressing spring piece 112 that is connected with the positioning member 11 in a tilt angle as illustrated in FIG. 1. A locking part 111 is provided in one distal end of the positioning member 11 for locking or positioning the interlocking teeth 141 of the teeth tapes 14 in place. When assembled, the locking part 111 is inserted into the recess 103. By pulling the pull tab unit 13 in a tilt angle relative to the top surface of the slide body 10, as indicated in FIG. 2 and FIG. 3, the locking part 111 separates from the interlocking teeth 141 to permit the sliding of the zipper slide.

Still referring to FIG. 2 and FIG. 3, the positioning member 11 and pull tab unit 12, which are both covered by the lid 12, facilitate manipulation of sliding the slide body to engage or disengage the metal teeth 141 of opposite teeth tapes 14. When the pull tab unit 13 is not pulled, the pressing spring piece 112 jabs an interior surface of the lid 12. By doing this, the pressing spring piece 112 provides the locking part 111 with a downward force to lock the teeth 141. On the contrary, by pulling the pull tab unit 13 in a tilt angle relative to the top surface of the slide body 10, the locking part 111 separates from the interlocking teeth 141 to permit the sliding of the zipper slide.

The drawback of the prior art structure is that the positioning member 11 with a tilt pressing spring piece 111 formed thereon is difficult to be made small in size by traditional punching technique. This leads to raising cost of the zipper products. Consequently, there is a strong need to provide an improved positioning mechanism to save the cost.

SUMMARY OF THE INVENTION

Accordingly, it is a primary object of the present invention to provide an improved needle locking or positioning mechanism for zipper slides to solve the above-mentioned problems. The needle locking mechanism according to this invention is capable of engaging with either metal teeth or plastic teeth in a more tight-knit way.

According to the claimed invention, a positioning mechanism of a zipper slide for engaging or disengaging two lengths of teeth on two opposite teeth tapes, comprising: a main body having a buckling portion, a plane surface, a recess, and a support portion formed thereon, wherein an engagement channel is formed in the main body; a positioning member positioned on the buckling portion of the main body, wherein the positioning member has a locking part, which inserts into the recess of the main body, formed in one end of the positioning member; a pull tab unit for facilitating the manipulation of pulling the zipper slide, wherein the pull tab unit has a beam that is placed on the plane surface; and a lid connected with a top surface of the main body and covering the buckling portion, the plane surface, the recess, the support portion, the positioning portion, and the front of the pull tab unit.

The buckling portion has a clipping slot formed thereon, the clipping slot clips one end of a restraining stick that is respectively made by using punching technique, and the other end of the restraining stick extends along the length of the positioning member to press the positioning member.

It is to be understood that both the forgoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENT

Figure 1:
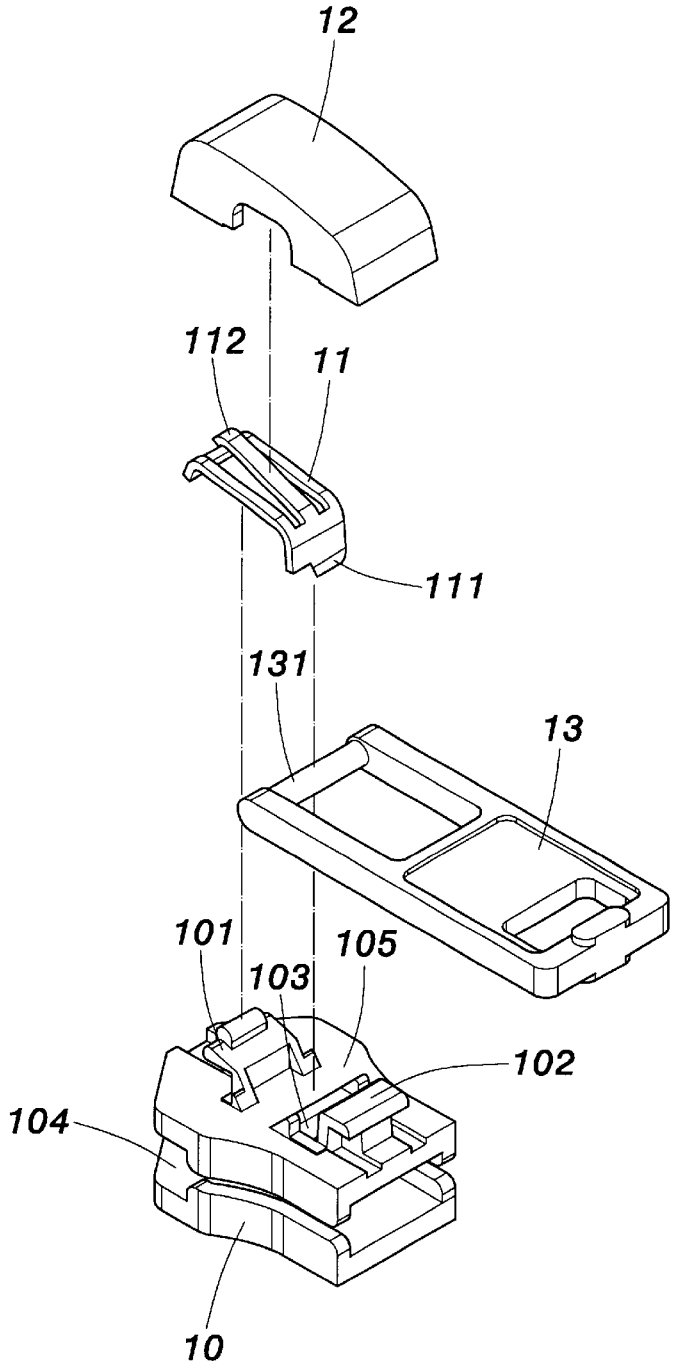
FIG. 1 PRIOR ART
FIG. 1 is an exploded diagram showing a prior art zipper slide.
Figure 2:
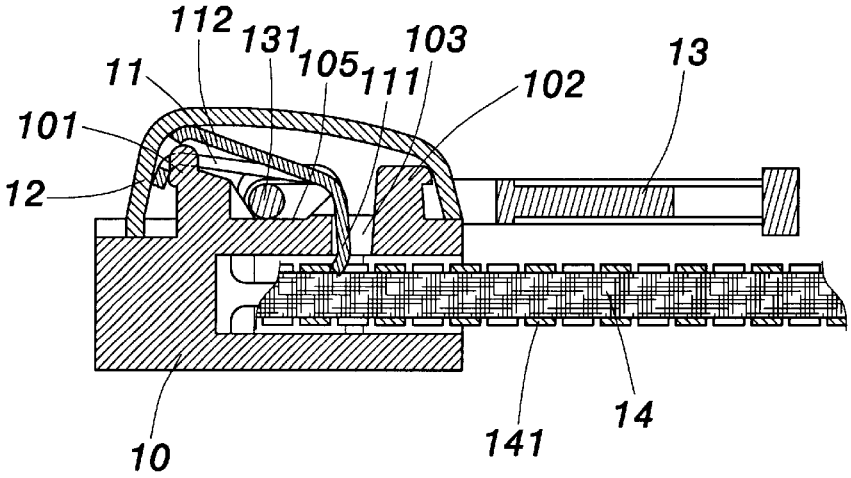
FIG. 2 PRIOR ART
FIG. 2 is a cross sectional diagram showing the prior art zipper slide of FIG. 1.
Figure 3:
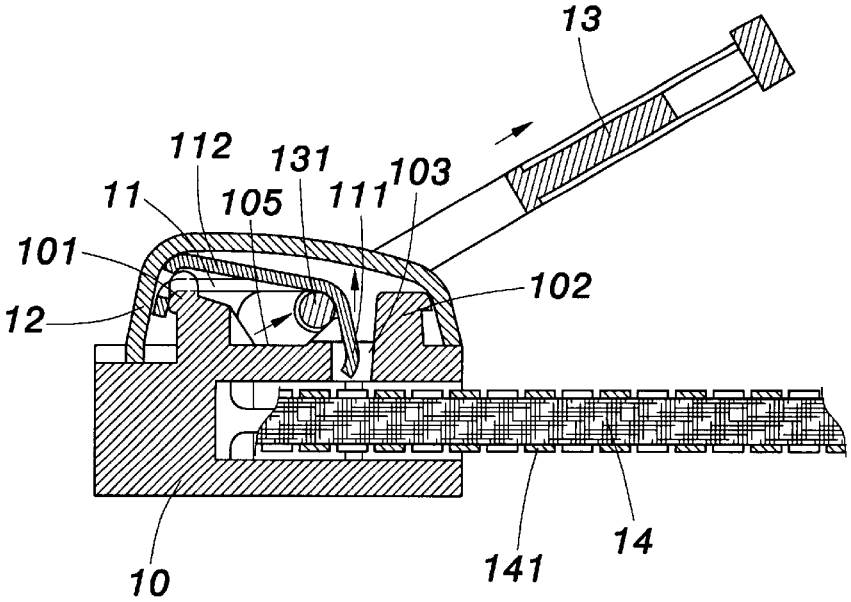
FIG. 3 PRIOR ART
FIG. 3 is a cross sectional diagram showing the prior art zipper slide of FIG. 1.
Figure 4:
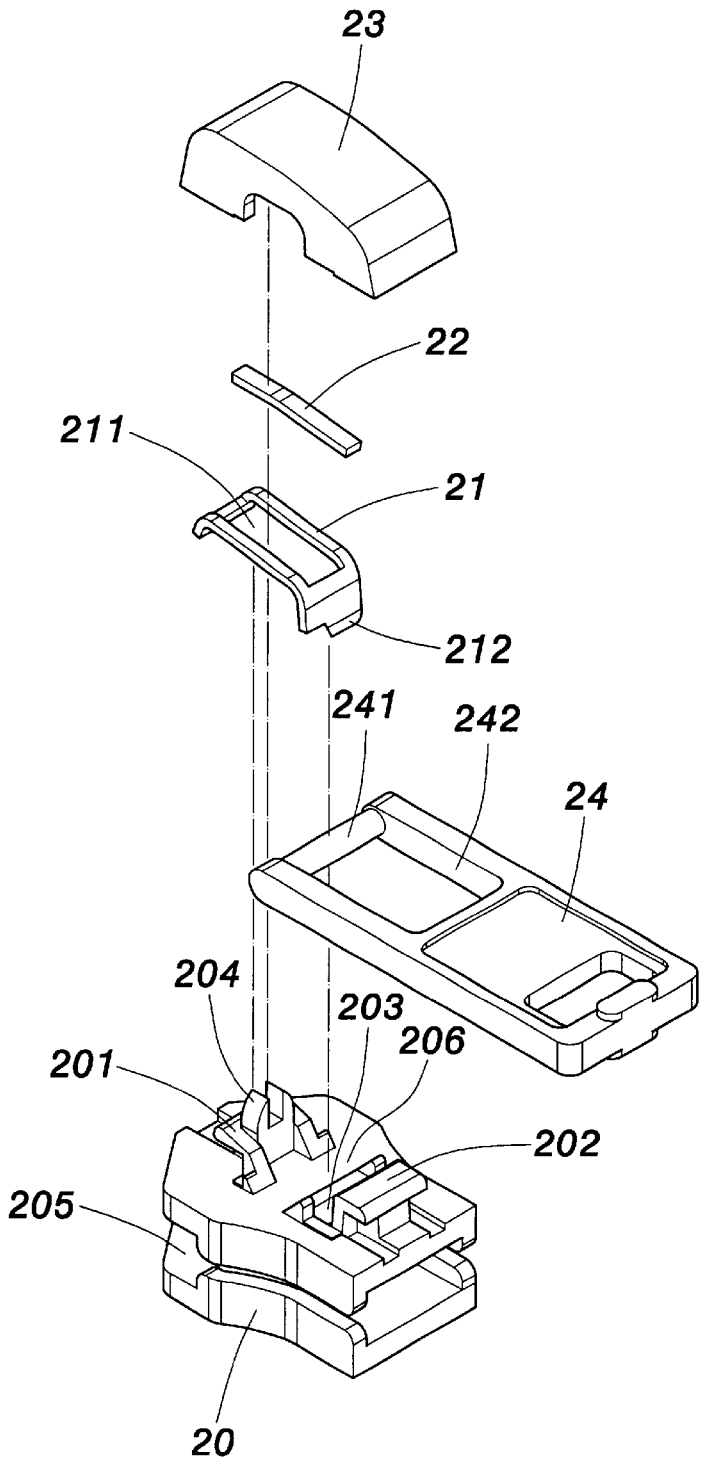
FIG. 4 is an exploded diagram illustrating this invention.
Figure 5:
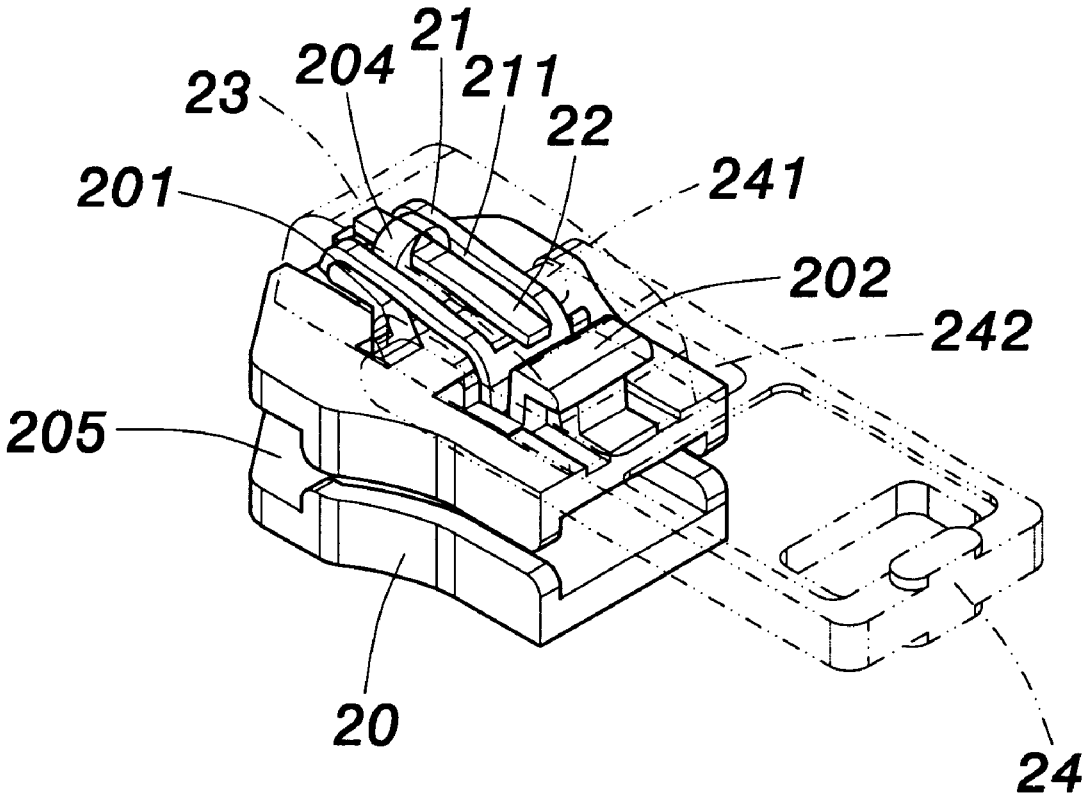
FIG. 5 is a perspective diagram showing this invention in combination.

Referring to FIGS. 4 and 5, this invention provides an improved locking or positioning mechanism for zipper slides. More particularly, this invention provides a positioning means that can be easily made and assembled. This positioning means of the invention generally comprises a monolithic main body 20, a positioning member 21, a restraining stick 22, a lid 23, and a pull tab unit 4.

The main body 20, the positioning member 21, the restraining stick 22, the lid 23, and the pull tab unit 4 may be made of aluminum alloys, zinc alloys or the like. Various colors of paint may be coated onto the surfaces of the main body 20, the positioning member 21, the restraining stick 22, the lid 23, and the pull tab unit 4 by means of coating dye or bake coating.

Likewise, on a top surface of the main body 20 there are provided a buckling portion 201 and a support portion 202. The buckling portion 201 and the support portion 202 are used to buckle the positioning member 21 and the lid 23, respectively. On top of the buckling portion 201 is provided a U-shaped clipping slot 204 for tightly fixing the restraining stick 22 (as indicated in FIG. 5). Between the buckling portion 201 and the support portion 202 there are provided a plane surface 206 and a recess 203. When assembled, a beam 241 of the pull tab unit 24 is placed on the plane surface 206. The lid 23 covers the buckling portion 201, the plane surface 206, the recess 203, the support portion 202, the positioning member 21, and the front of the pull tab unit 24.

Figure 6:
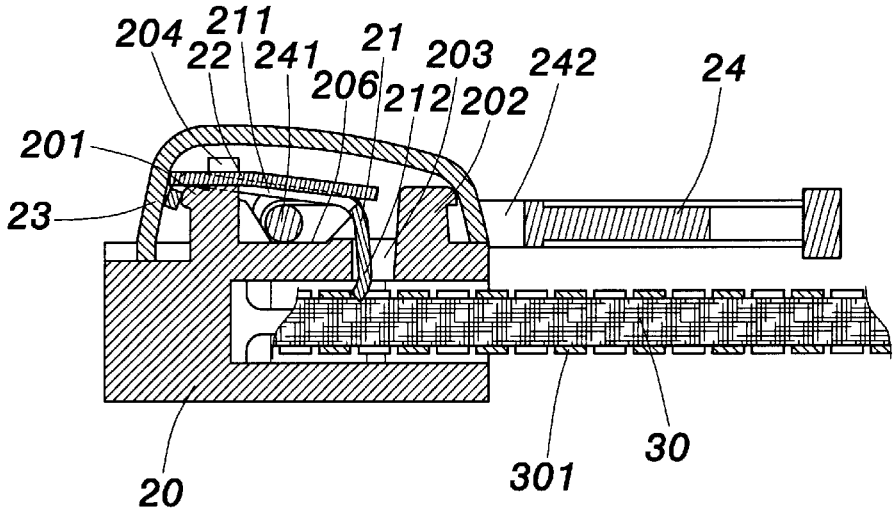
FIG. 6 is a schematic diagram illustrating the use of this invention.

Engagement channel 205 is provided in a front end of the main body 20. As shown in FIG. 6, the engagement channel 205 slides along the lengths of interlocking teeth 301 of the teeth tapes 30 to facilitate the engagement and disengagement thereof.

Figure 7:
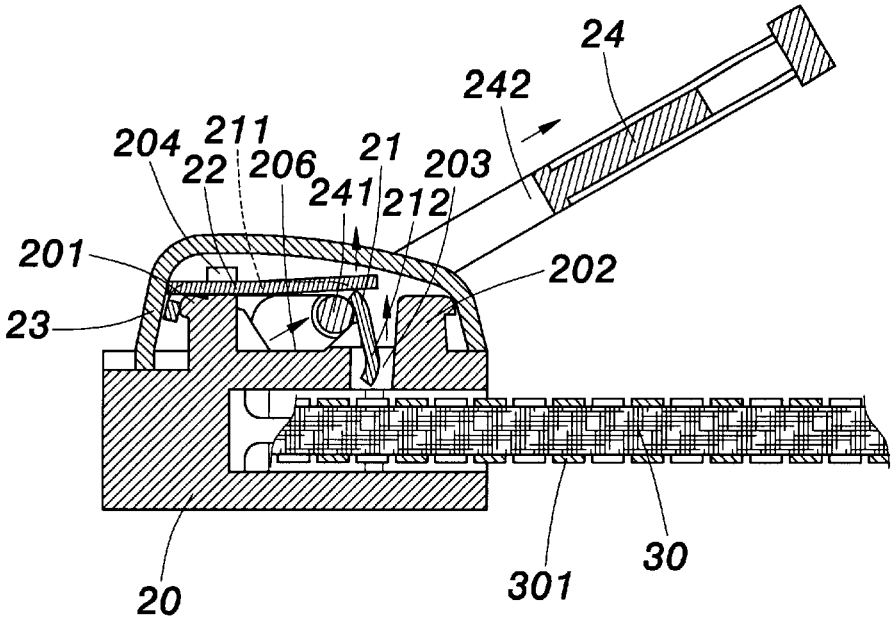
FIG. 7 is a cross sectional diagram showing this invention.

The positioning member 21 is monolithically made by using punching technique. An aperture 211 is provided in the positioning member 21 for allowing the pass of the clipping slot 204 of the buckling portion 201. When assembled, the positioning member 21 is placed on the buckling portion 201 and is in connection with the lid 23. A locking part 212 is provided in one distal end of the positioning member 21 for locking or positioning the interlocking teeth 301 of the teeth tapes 30 in place. When assembled, the locking part 212 is inserted into the recess 203. By pulling the pull tab unit 24 in a tilt angle relative to the top surface of the main body 20, as indicated in FIG. 6 and FIG. 7, the locking part 212 separates from the interlocking teeth 301 to permit the sliding of the zipper slide.

The restraining stick 22 is also monolithically made by punching technique. Preferably, the restraining stick 22 is thin belt shaped. When assembled, one end of the restraining stick 22 is tightly fixed by the clipping slot 204 on top of the buckling portion 201 (as shown in FIG. 5). The other end of the restraining stick 22 extends forwardly along the length of the aperture 211 of the positioning member 21. The restraining stick 22 jabs one side of the aperture 211 to provide the locking part 212 of the positioning member 21 with a downward force that allows the locking part 212 to engage with the interlocking teeth 301 within the recess 203 of the main body 20 (as shown in FIG. 7)

The lid 23 is monolithically made by using punching technique. The lid 23 covers the buckling portion 201 of the main body 20, the support portion 202, the positioning member 21, the restraining stick 22 and the front of the pull tab unit 24.

The lid 23 buckles the pull tab unit 24 by passing through opening 242 of the pull tab unit 24. As illustrated, the opening 242 is formed on the pull tab unit 24 and is designed to allow the passing of the lid 23. One side of the opening 242 is a beam 241. The beam 241 is placed on the plane surface 206 of the main body 20. Trademarks, totems or other patterns may be placed on the pull tab unit 24. The pull tab unit 24 facilitates manipulation of sliding the main body 20 to engage or disengage the metal teeth 301 of opposite teeth tapes 30.

From above, the positioning structure according to this invention at least includes the following features:

(1) The restraining stick 22 is respectively made. Hence, the positioning member 21 has a simple structure that can be easily made by using traditional punching technique.

(2) Proportion defective is thus lowered.

(3) The improved positioning mechanism is longwearing and functions well.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. A positioning mechanism of a zipper slide, comprising:

a main body having a buckling portion, a plane surface, a recess, and a support portion formed thereon, wherein an engagement channel is formed in the main body, the buckling portion forming a clipping slot;

a positioning member having a first end engaging the buckling portion of the main body, and a second end defining a locking part inserting into the recess of the main body, a pull tab unit coupled to the main body the pull tab unit having a beam formed at a front end thereof disposed on the plane surface;

a lid coupled to the main body and covering the buckling portion, the plane surface, the recess, the support portion, the positioning member, and the front end of the pull tab unit;

a restraining stick coupled at an inner end portion to the clipping slot of the buckling portion, the restraining stick having a free outer end portion bearing against the positioning member for biasing the second end thereof along a predetermined direction, the restraining stick being made by punching technique.

2. The positioning mechanism of claim 1 wherein various colors of paint may be coated onto the surfaces of the main body, the positioning member, the restraining stick, the lid, and the pull tab unit by means of coating dye or bake coating.

3. The positioning mechanism of claim 1 wherein the locking part engages with teeth of zipper tapes.

4. The positioning mechanism of claim 1 wherein trademarks, totems or other patterns may be placed on the pull tab unit.

5. The positioning mechanism of claim 1 wherein an aperture is formed in the positioning member.

6. The positioning mechanism of claim 5 wherein the aperture is formed in an intermediate portion of the positioning member extending between the first and second ends thereof.

7. The positioning mechanism of claim 6 wherein the restraining stick extends through the aperture of the positioning member to contact the second end thereof.

* * * * *